US011183152B2

(12) United States Patent
Shih et al.

(10) Patent No.: US 11,183,152 B2
(45) Date of Patent: Nov. 23, 2021

(54) METHOD FOR COMPENSATING FOR BRIGHTNESS OF ABNORMAL PIXEL OF DISPLAY DEVICE

(71) Applicant: Innolux Corporation, Miao-Li County (TW)

(72) Inventors: Ming-Chia Shih, Miao-Li County (TW); Chin-Lung Ting, Miao-Li County (TW); Chi-Feng Chen, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 16/936,429

(22) Filed: Jul. 23, 2020

(65) Prior Publication Data

US 2021/0049978 A1 Feb. 18, 2021

Related U.S. Application Data

(60) Provisional application No. 62/885,869, filed on Aug. 13, 2019.

(30) Foreign Application Priority Data

Jun. 22, 2020 (CN) ..... 202010573092.8

(51) Int. Cl.
*G09G 5/10* (2006.01)

(52) U.S. Cl.
CPC ..... *G09G 5/10* (2013.01); *G09G 2310/027* (2013.01); *G09G 2320/0233* (2013.01); *G09G 2320/0653* (2013.01); *G09G 2360/148* (2013.01)

(58) Field of Classification Search
CPC ..... G09G 2330/10; G09G 2320/0653; G09G 2320/0285; G09G 2320/0233; G09G 2360/148; G09G 5/10; G09G 2310/027; G09G 3/20; G09G 3/32
See application file for complete search history.

(56) References Cited

U.S. PATENT DOCUMENTS

2018/0108679 A1 4/2018 Wu et al.
2020/0027944 A1* 1/2020 Xuan ..... H01L 27/3276

* cited by examiner

*Primary Examiner* — Charles V Hicks
(74) *Attorney, Agent, or Firm* — JCIPRNET

(57) ABSTRACT

A method for compensating for a brightness of an abnormal pixel of a display device is provided. The display device includes a plurality of normal pixels. The method includes: enhancing a brightness of at least one of the normal pixels to compensate for the brightness of the abnormal pixel. The at least one of the normal pixels has a same color as the abnormal pixel, and is adjacent to the abnormal pixel.

8 Claims, 3 Drawing Sheets

| | | |
|---|---|---|
| 132_A1 | 132_A2 | 132_A3 |
| 132_A4 | 134_B | 132_A5 |
| 132_A6 | 132_A7 | 132_A8 |

METHOD FOR COMPENSATING FOR BRIGHTNESS OF ABNORMAL PIXEL OF DISPLAY DEVICE

CROSS-REFERENCE TO RELATED APPLICATION

This application claims the priority benefit of U.S. application Ser. No. 62/885,869, filed on Aug. 13, 2019, and China application serial no. 202010573092.8, filed on Jun. 22, 2020. The entirety of each of the above-mentioned patent applications is hereby incorporated by reference herein and made a part of this specification.

BACKGROUND

Technical Field

The disclosure relates to a compensation method, in particular to a method for compensating for brightness of an abnormal pixel of a display device.

Description of Related Art

Display devices include pixels for displaying images. However, in the display devices, the pixels are likely to be rendered abnormal during manufacturing due to factors such as the process, and cannot emit light in a normal manner. Therefore, a dark spot or a defective spot is generated in the display device. The dark spot or the defective spot results in uneven brightness of the display device, thereby failing to provide a good user experience. Therefore, it is currently one of the important issues to achieve display brightness uniformity in the display device using an appropriate compensating method to compensate for the brightness of the abnormal pixel of the display device.

SUMMARY

Brightness uniformity in the display device can be achieved using the compensation method of the disclosure to compensate for the brightness of the abnormal pixel of the display device.

The disclosure provides a method for compensating for a brightness of an abnormal pixel of a display device. The display device includes a plurality of normal pixels The method includes the following step. A brightness of at least one of the normal pixels is enhanced to compensate for the brightness of the abnormal pixel. The at least one of the normal pixels has a same color as the abnormal pixel, and is adjacent to the abnormal pixel.

In an embodiment of the disclosure, enhancing the brightness of the at least one of the normal pixels to compensate for the brightness of the abnormal pixel includes the following steps. An image signal corresponding to each of the at least one of the normal pixels is provided. The image signal includes an original grey level. Also, an updated image signal including an escalated grey level is generated from the image signal. Further, the updated image signal is provided to each of the at least one of the normal pixels.

In an embodiment of the disclosure, generating the updated image signal including the escalated grey level from the image signal includes the following steps. A weight ratio corresponding to each of the at least one of the normal pixels is provided. The weight ratio is greater than zero and not greater than 1. Also, the original grey level and an increment weight of each of the at least one of the normal pixels is summed to obtain the corresponding escalated grey level. The increment weight is derived from multiplying the original grey level by the weight ratio.

In an embodiment of the disclosure, a sum of the weight ratios of the at least one of the normal pixels is in a range from 0.5 to 2.

In an embodiment of the disclosure, a sum of the weight ratios of the at least one of the normal pixels is in a range from 0.8 to 1.2.

In an embodiment of the disclosure, a sum of the weight ratios of the at least one of the normal pixels is equal to 1.

In an embodiment of the disclosure, the weight ratios of the at least one of the normal pixels are identical.

In an embodiment of the disclosure, enhancing the brightness of the at least one of the normal pixels to compensate for the brightness of the abnormal pixel includes the following steps. An image signal corresponding to each of at least two of the normal pixels is provided. The image signal includes an original grey level. A second normal pixel of the at least two of the normal pixels is located at a position closer to the abnormal pixel, compared with a first normal pixel of the at least two of the normal pixels. Also, an updated image signal including an escalated grey level is generated from the image signal. The escalated grey level of the second normal pixel is higher, compared with the escalated grey level of the first normal pixel. Further, the updated image signal is provided to each of the at least two of the normal pixels.

In an embodiment of the disclosure, generating the updated image signal including the escalated grey level from the image signal includes the following steps. An image signal corresponding to the abnormal pixel is further provided. The image signal includes a grey level. Also, a weight ratio corresponding to each of the at least one of the normal pixels is provided. The weight ratio is greater than zero and not greater than 1. Further, the original grey level and an increment weight of each of the at least one of the normal pixels is summed to obtain the corresponding escalated grey level. The increment weight is derived from multiplying the grey level of the abnormal pixel by the weight ratio.

To make the aforementioned more comprehensible, several embodiments accompanied with drawings are described in detail as follows.

DESCRIPTION OF THE EMBODIMENTS

Figure 1:
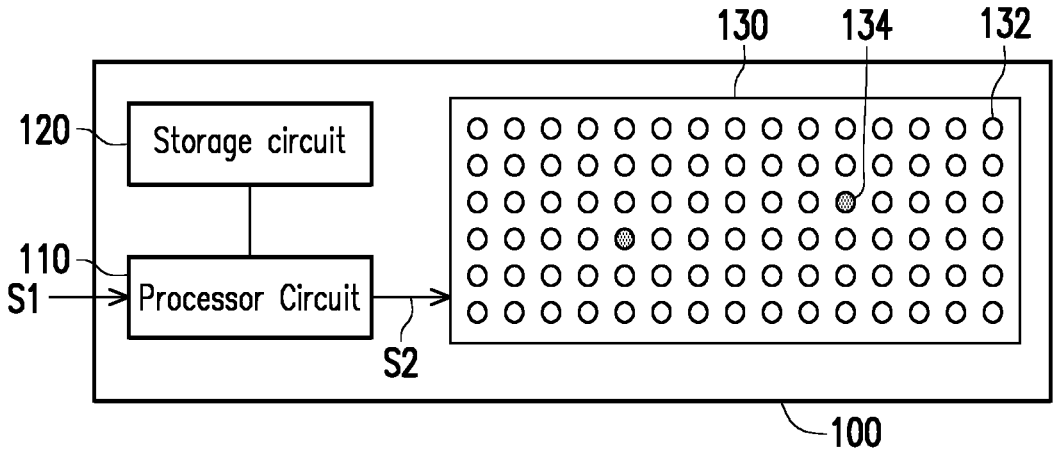
FIG. 1 is a schematic diagram outlining a display device according to an embodiment of the disclosure.

Reference will now be made in detail to the exemplary embodiments of the disclosure, examples of which are illustrated in the accompanying drawings. Wherever possible, the same element symbols are used in the drawings and description to denote the same or similar parts.

FIG. 1 is a schematic diagram outlining a display device according to an embodiment of the disclosure. Referring to FIG. 1, a display device 100 in this embodiment includes a processor circuit 110, a storage circuit 120, and a display panel 130. The display device 100 may, for example, be a display or a backlight source of a display. The disclosure does not limit the types of the display device 100. The display panel 130 includes a plurality of pixels 132. An image signal S1 is provided to the processor circuit 110, and the processor circuit 110 is configured to provide an updated image signal S2 to the pixels 132. The pixels 132 as light emitting units may, for example, include sub-pixels in three colors, such as red sub-pixels, green sub-pixels, and blue sub-pixels. Alternatively, the red sub-pixels, the green sub-pixels, and the blue sub-pixels may also be distributed in different light emitting units. The light emitting units may also include white sub-pixels. The disclosure does not limit the types of the pixels 132.

The display device 100 may include, for example, a liquid crystal or a light emitting diode (LED) as a light emitting unit. The LED may include, for example, an organic light emitting diode (OLED), a mini LED, a micro LED, or a quantum dot light emitting diode (e.g., QLED, QDLED), fluorescence, a phosphor, or other suitable materials, or any arrangement and combination thereof, but is not limited thereto. Therefore, the display device 100 includes an LED chip or an LED package. Take the mini LED display device as an example. The mini LED display device includes LED packages including red, green, and blue LED chips. On the other hand, the mini LED display device may also include an LED package including a white LED chip.

The processor circuit 110 is configured to execute a method for compensating for a brightness of an abnormal pixel 134 of the display device 100. Firstly, the display panel 130 is lit on through red, green, blue, or white patterns to detect a coordinate position of the abnormal pixel 134. The display panel 130 may include one or a plurality of abnormal pixels 134. The abnormal pixel 134 is not limited to pixels that are completely unlit, but may as well be pixels that can be lit but cannot display corresponding grey levels. Next, the processor circuit 110 records the coordinate position of the abnormal pixel 134 in the storage circuit 120 so as to compensate for the brightness of the abnormal pixel 134.

The processor circuit 110 may be a processor having a computation capability. Alternatively, the processor circuit 110 may be designed through hardware description languages (HDL) or any other designing method for digital circuits familiar to people having ordinary skill in the art. In addition, the processor circuit 110 may also be a hardware circuit realized through a field programmable gate array (FPGA), a complex programmable logic device (CPLD), or an application-specific integrated circuit (ASIC). The storage circuit 120 may include volatile memory, or non-volatile memory. Moreover, sufficient teaching, suggestions, and implementation instructions regarding the hardware structures of the processor circuit 110 and the storage circuit 120 can be obtained from conventional technologies in the art, and are not repeatedly described herein.

Figure 2:
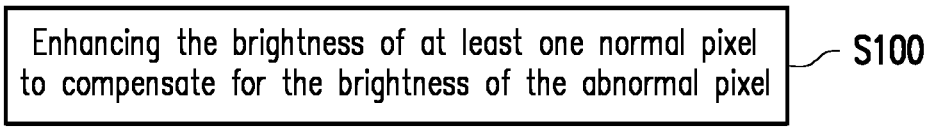
FIG. 2 is a schematic diagram outlining a method for compensating for the brightness of the abnormal pixel of the display device according to an embodiment of the disclosure.

FIG. 2 is a schematic diagram outlining a method for compensating for the brightness of the abnormal pixel of the display device according to an embodiment of the disclosure. Referring to FIG. 1 and FIG. 2, the method for compensating for the brightness of the abnormal pixel of the display device in this embodiment is at least applicable to the display device 100 shown in FIG. 1. In step S100, the processor circuit 110 enhances a brightness of at least one of the normal pixels 132 to compensate for the brightness of the abnormal pixel 134. In this embodiment, the at least one of the normal pixels 132 whose brightness is enhanced has a same color as the abnormal pixel 134, and is adjacent to the abnormal pixel 134.

Figure 3:
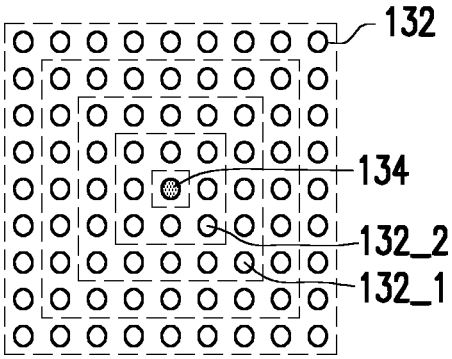
FIG. 3 shows the abnormal pixel and the normal pixels adjacent thereto according to an embodiment of the disclosure.

FIG. 3 shows the abnormal pixel and the normal pixels adjacent thereto according to an embodiment of the disclosure. Referring to FIG. 3, as shown in FIG. 3, the normal pixels 132 within the first to the fourth circles expanding outward the abnormal pixel 134 as a center are all normal pixels 132 which are adjacent to the abnormal pixel 134, and the brightness thereof may be enhanced to compensate for the brightness of the abnormal pixel 134. The number of the circles is not limited thereto.

Figure 4:
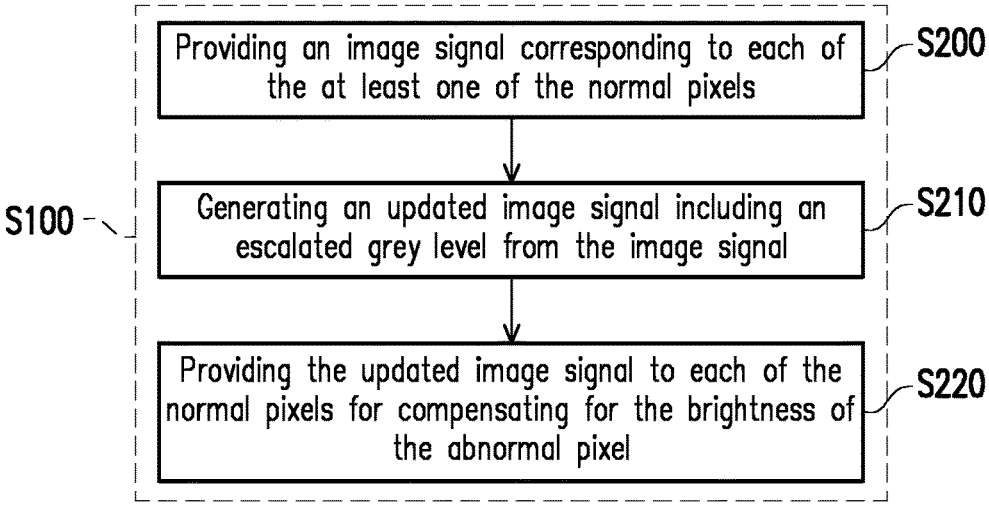
FIG. 4 is a detailed flowchart showing steps of enhancing the brightness of the normal pixels to compensate for the brightness of the abnormal pixel according to an embodiment of the disclosure.

FIG. 4 is a detailed flowchart showing steps of enhancing the brightness of the normal pixels to compensate for the brightness of the abnormal pixel according to an embodiment of the disclosure. Referring to FIG. 1, FIG. 2, and FIG. 4, in this embodiment, step S100 includes steps S200, S210, and S220. In step S200, an image signal corresponding to each of the normal pixels 132 which are configured to compensate for the abnormal pixel 134 and which are adjacent to the abnormal pixel 134 is provided to the processor circuit 110, the image signal includes an original grey level. Different normal pixels 132 can have different original grey levels. In step S210, the processor circuit 110 generates an updated image signal S2 which includes an escalated grey level from an image signal S1. The escalated grey level is a grey level obtained after increasing a value of the original grey level. The method for generating the escalated grey level is performing calculation on the original grey level by the processor circuit 110 through an internal algorithm to generate the escalated grey level. In step S220, the processor circuit 110 provides the updated image signal S2 to each of the normal pixels 132 which are configured to compensate for the abnormal pixel 134 and which are adjacent to the abnormal pixel 134.

Figure 5:
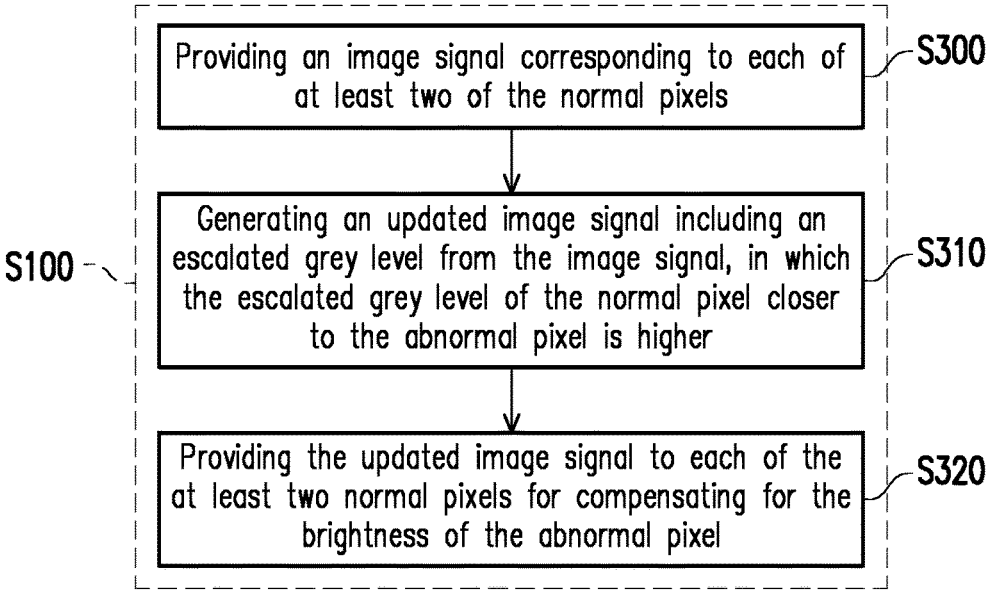
FIG. 5 is a detailed flowchart showing steps of enhancing the brightness of the normal pixels to compensate for the brightness of the abnormal pixel according to another embodiment of the disclosure.

FIG. 5 is a detailed flowchart showing steps of enhancing the brightness of the normal pixels to compensate for the brightness of the abnormal pixel according to another embodiment of the disclosure. Referring to FIG. 1, FIG. 3, and FIG. 5, in this embodiment, the normal pixels 132 include a first normal pixel 132_1, and a second normal pixel 132_2, as shown in FIG. 3. Compared with the first normal pixel 132_1, the second normal pixel 132_2 is located closer to the abnormal pixel 134. For example, the first normal pixel 132_1 may be one normal pixel located in the second circle, the second normal pixel 132_2 may be one normal pixel located in the first circle, and the second normal pixel 132_2 is located closer to the abnormal pixel 134. In another embodiment, the second normal pixel 132_2 may be located in the first circle and is located above, below, left to, or right to the abnormal pixel, and the first normal pixel 132_1 is located in the first circle and is located at a diagonal corner with respect to the abnormal pixel.

In this embodiment, step S100 includes steps S300, S310, and S320. In step S300, an image signal S1 corresponding to each of the first normal pixel 132_1 and the second normal pixel 132_2 is provided to the processor circuit 110, and the image signal S1 includes an original grey level. In step S310, the processor circuit 110 generates an updated image signal S2 which includes an escalated grey level from the image signal S1. Compared with the escalated grey level of the first normal pixel 132_1, the escalated grey level of the second normal pixel 132_2 is higher. That is to say, between the normal pixels 132_1 and 132_2, which are adjacent to the abnormal pixel 134 and which are configured to compensate for the abnormal pixel 134, the second normal pixel 132_2, which is closer to the abnormal pixel 134, has a higher escalated grey level, compared to the first normal pixel 132_1, which is farther from the abnormal pixel 134. In step S320, the processor circuit 110 provides the updated image signal S2 to each of the first normal pixel 132_1 and the second normal pixel 132_2.

Figure 6:
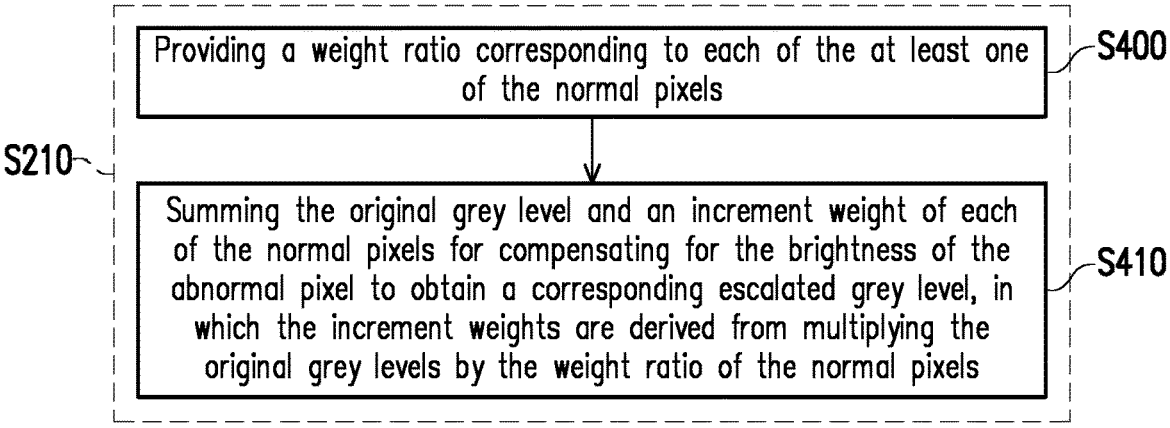
FIG. 6 is a detailed flowchart showing steps of generating the updated image signal from the image signal according to an embodiment of the disclosure.
Figures 7, 8:
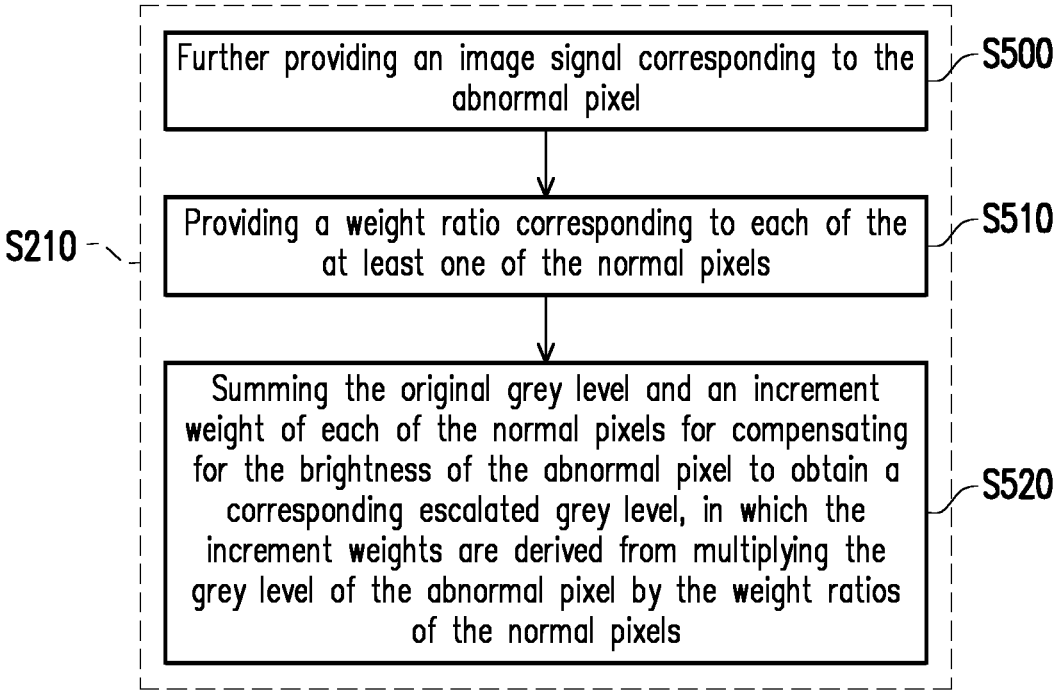
FIG. 7 shows an abnormal pixel and normal pixels adjacent thereto according to another embodiment of the disclosure.
FIG. 8 is a detailed flowchart showing steps of generating the updated image signal from the image signal according to another embodiment of the disclosure.

FIG. 6 is a detailed flowchart showing steps of generating the updated image signal from the image signal according to an embodiment of the disclosure. FIG. 7 shows an abnormal pixel and normal pixels adjacent thereto according to another embodiment of the disclosure. Referring to FIG. 6 and FIG. 7, in FIG. 7, 134_B is an abnormal pixel, and 132_A1 to 132_A8 are normal pixels adjacent to the abnormal pixel. In this embodiment, the processor circuit 110 calculates an original grey level through a first algorithm to generate an escalated grey level. The first algorithm is as follows:

$$Ai'=(1+ai)\times Ai,$$

in which i=1-8, Ai is the original grey level, Ai' is the escalated grey level, ai is a weight ratio, the weight ratio ai is greater than 0 and not greater than 1, ai×Ai is an increment weight, and the increment weight ai×Ai is derived from multiplying the original grey level Ai of the normal pixels by the weight ratio ai.

In this embodiment, step S210 includes steps S400 and S410. In step S400, the processor circuit 110 provides the weight ratio ai corresponding to each of the normal pixels 132_A1 to 132_A8. In step S410, the processor circuit 110 sums the original grey level Ai and the increment weight ai×Ai of each of the normal pixels 132_A1 to 132_A8 to obtain the corresponding escalated grey level Ai'. In this embodiment, the first algorithm does not consider a grey level which was originally to be displayed by the abnormal pixel 134_B.

In one embodiment, a sum of the respective weight ratios ai of the normal pixels 132_A1 to 132_A8 is between 0.5 and 2. In one embodiment, a sum of the respective weight ratio ai of the normal pixels 132_A1 to 132_A8 is between 0.8 and 1.2. In one embodiment, a sum of the respective weight ratio ai of the normal pixels 132_A1 to 132_A8 is equal to 1. In one embodiment, the respective weight ratios ai of the normal pixels 132_A1 to 132_A8 are identical.

FIG. 8 is a detailed flowchart showing steps of generating the updated image signal from the image signal according to another embodiment of the disclosure. Referring to FIG. 7 and FIG. 8, in this embodiment, the processor circuit 110 calculates an original grey level by a second algorithm to generate an escalated grey level. The second algorithm is as follows:

$$Ai'=Ai+ai\times B,$$

in which i=1-8, Ai is the original grey level, Ai' is the escalated grey level, B is a grey level of the abnormal pixel, ai is a weight ratio, the weight ratio ai is greater than 0 and not greater than 1, ai×B is an increment weight, and the increment weight ai×B is derived from multiplying the grey level B of the abnormal pixel by the weight ratio ai of the normal pixels.

In this embodiment, step S210 includes steps S500, S510, and S520. In step S500, an image signal S1 corresponding to the abnormal pixel 134_B is further provided to the processor circuit 110, and the image signal S1 includes a grey level. In step S510, the processor circuit 110 provides the weight ratio ai corresponding to each of the normal pixels 132_A1 to 132_A8. The processor circuit 110 sums the original grey level Ai and the increment weight ai×B of each of the normal pixels 132_A1 to 132_A8 to obtain the corresponding escalated grey level Ai'. In this embodiment, the second algorithm considers the grey level which was originally to be displayed by the abnormal pixel 134_B.

In summary of the foregoing, in the embodiments of the disclosure, the processor circuit detects the coordinate position of the abnormal pixel, and executes a method for compensating for the brightness of the abnormal pixel of the display device. The processor circuit enhances the brightness of the normal pixel adjacent to and having the same color as the abnormal pixel to compensate for the brightness of the abnormal pixel. The processor circuit calculates the original grey level of the normal pixel or the grey level of the abnormal pixel through the internal algorithm to generate the corresponding escalated grey level, and provide the updated image signal including the escalated grey level to each normal pixel configured to compensate for the brightness of the abnormal pixel to compensate for the brightness of the abnormal pixel.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A method for compensating for a brightness of an abnormal pixel of a display device, the display device comprising a plurality of normal pixels, wherein the method comprises:

enhancing a brightness of at least one of the normal pixels to compensate for the brightness of the abnormal pixel, wherein the at least one of the normal pixels has a same color as the abnormal pixel, and is adjacent to the abnormal pixel, wherein the step of enhancing the brightness of the at least one of the normal pixels to compensate for the brightness of the abnormal pixel comprises:

providing an image signal corresponding to each of the at least one of the normal pixels, wherein the image signal comprises an original grey level;

generating an updated image signal comprising an escalated grey level from the image signal; and providing the updated image signal to each of the at least one of the normal pixels.

2. The method according to claim 1, wherein the step of generating the updated image signal comprising the escalated grey level from the image signal comprises:

providing a weight ratio corresponding to each of the at least one of the normal pixels, wherein the weight ratio is greater than zero and not greater than 1; and summing the original grey level and an increment weight of each of the at least one of the normal pixels to obtain a corresponding one of the escalated grey level, wherein the increment weight is derived from multiplying the original grey level by the weight ratio.

3. The method according to claim 2, wherein a sum of the weight ratios of the at least one of the normal pixels is in a range from 0.5 to 2.

4. The method according to claim 3, wherein the sum of the weight ratios of the at least one of the normal pixels is in a range from 0.8 to 1.2.

5. The method according to claim 4, wherein the sum of the weight ratios of the at least one of the normal pixels is equal to 1.

6. The method according to claim 5, wherein the weight ratios of the at least one of the normal pixels are identical.

7. The method according to claim 1, wherein the step of generating the updated image signal comprising the escalated grey level from the image signal comprises:

further providing an image signal corresponding to the abnormal pixel, wherein the image signal comprises a grey level;

providing a weight ratio corresponding to each of the at least one of the normal pixels, wherein the weight ratio is greater than zero and not greater than 1; and summing the original grey level and an increment weight of each of the at least one of the normal pixels to obtain a corresponding one of the escalated grey level, wherein the increment weight is derived from multiplying the grey level of the abnormal pixel by the weight ratio.

8. A method for compensating for a brightness of an abnormal pixel of a display device, the display device comprising a plurality of normal pixels, wherein the method comprises:

enhancing a brightness of at least one of the normal pixels to compensate for the brightness of the abnormal pixel, wherein the at least one of the normal pixels has a same color as the abnormal pixel, and is adjacent to the abnormal pixel wherein the step of enhancing the brightness of the at least one of the normal pixels to compensate for the brightness of the abnormal pixel comprises:

providing an image signal corresponding to each of at least two of the normal pixels, the image signal comprising an original grey level, wherein a second normal pixel of the at least two of the normal pixels is located at a position closer to the abnormal pixel, compared with a first normal pixel of the at least two of the normal pixels;

generating an updated image signal comprising an escalated grey level from the image signal, wherein the escalated grey level of the second normal pixel is higher, compared with the escalated grey level of the first normal pixel; and providing the updated image signal to each of the at least two of the normal pixels.

* * * * *